US009851094B2

(12) United States Patent
Gommans et al.

(10) Patent No.: US 9,851,094 B2
(45) Date of Patent: Dec. 26, 2017

(54) LIGHT-EMITTING ACOUSTIC PANEL AND LIGHTING SYSTEM COMPRISING A SET OF SUCH PANELS

(71) Applicant: PHILIPS LIGHTING HOLDING B.V., Eindhoven (NL)

(72) Inventors: Hendrikus Hubertus Petrus Gommans, Eindhoven (NL); Jasper Van Dorp Schuitman, Eindhoven (NL); Amin Gerhard Kohlrausch, Eindhoven (NL); Ronaldus Maria Aarts, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/306,098

(22) PCT Filed: Apr. 14, 2015

(86) PCT No.: PCT/EP2015/058012
§ 371 (c)(1),
(2) Date: Oct. 23, 2016

(87) PCT Pub. No.: WO2015/162030
PCT Pub. Date: Oct. 29, 2015

(65) Prior Publication Data

US 2017/0159928 A1 Jun. 8, 2017

(30) Foreign Application Priority Data

Apr. 25, 2014 (EP) ..... 14166026

(51) Int. Cl.
*F21V 33/00* (2006.01)
*E04B 9/32* (2006.01)
(Continued)

(52) U.S. Cl.
CPC ..... *F21V 33/006* (2013.01); *E04B 9/32* (2013.01); *E04B 9/34* (2013.01); *F21S 2/00* (2013.01);
(Continued)

(58) Field of Classification Search
CPC .... E04B 9/32; E04B 9/34; F21S 8/036; F21S 8/04; F21S 8/043; F21S 8/06; F21S 8/061;
(Continued)

(56) References Cited

U.S. PATENT DOCUMENTS 2,710,335 A * 6/1955 Wong ..... F21V 3/00 181/289
2,715,449 A * 8/1955 Smith ..... E04B 1/8209 181/295
(Continued)

FOREIGN PATENT DOCUMENTS

CN 201649404 U 11/2010
EP 2180109 A2 4/2010
(Continued)

OTHER PUBLICATIONS

"Philips Creates Acoustic Panels Embedded with LEDs to Light up your Room", http://elitechoice.org/2011/07/15/philips-creates-acoustic-panels-embedded-with-leds-.
(Continued)

*Primary Examiner* — Jong-Suk (James) Lee
*Assistant Examiner* — Zheng Song

(57) ABSTRACT

The invention relates to a set (1) of panels forming a lighting system, the set comprising a light-emitting panel (2) and a light-reflecting panel (3), each panel having two opposing first sides (4), two opposing second sides (5) and two opposing main surfaces (6). Each panel is suspended from a ceiling (7) with a first side (4) thereof facing the ceiling. The
(Continued)

light-emitting panel (2) comprises a light source (11) arranged on a second side (5) thereof. The second side (5) of the light-emitting panel (2) faces a main surface (6) of the light-reflecting panel (3) such that the light source (11) is arranged to illuminate the main surface (6) of the light-reflecting panel (3). The invention also relates to a lighting system including such set of panels and an acoustic panel as such.

9 Claims, 14 Drawing Sheets

(51) Int. Cl.

| | |
|---|---|
| ***F21S 2/00*** | (2016.01) |
| *E04B 9/34* | (2006.01) |
| *E04B 9/36* | (2006.01) |
| *F21S 8/06* | (2006.01) |
| *F21V 7/00* | (2006.01) |
| *F21V 7/05* | (2006.01) |
| *F21Y 103/10* | (2016.01) |
| *F21Y 115/10* | (2016.01) |
| *F21Y 109/00* | (2016.01) |
| *F21W 131/402* | (2006.01) |

(52) U.S. Cl.
CPC ..... *E04B 9/345* (2013.01); *E04B 9/366* (2013.01); *F21S 8/06* (2013.01); *F21V 7/0008* (2013.01); *F21V 7/05* (2013.01); *F21W 2131/402* (2013.01); *F21Y 2103/10* (2016.08); *F21Y 2109/00* (2016.08); *F21Y 2115/10* (2016.08)

(58) Field of Classification Search
CPC ..... F21S 8/063; G09F 2013/0436; G09F 2013/0445; G09F 2013/049; G09F 2013/1881; G09F 2013/222; G10K 11/172
See application file for complete search history.

(56) References Cited

U.S. PATENT DOCUMENTS

| | | | | |
|---|---|---|---|---|
| 3,774,024 | A | 11/1973 | Deaton | |
| 4,137,678 | A * | 2/1979 | Varlonga | E04B 9/34 52/144 |
| 6,174,069 | B1 * | 1/2001 | Plunk | F21S 8/06 362/147 |
| 2007/0000201 | A1 * | 1/2007 | Kennedy | E04B 9/006 52/506.06 |
| 2010/0079983 | A1 * | 4/2010 | Kumamoto | F21S 8/02 362/147 |
| 2010/0110674 | A1 * | 5/2010 | Hysky | E04B 9/366 362/234 |
| 2012/0257394 | A1 * | 10/2012 | Kikoski | F21S 8/061 362/311.02 |
| 2013/0047541 | A1 | 2/2013 | Mayer | |
| 2013/0148357 | A1 * | 6/2013 | Johnston | E04B 9/32 362/253 |
| 2013/0201636 | A1 | 8/2013 | Van Den Brand et al. | |
| 2015/0136521 | A1 * | 5/2015 | Swinkels | E04C 2/324 181/290 |

FOREIGN PATENT DOCUMENTS

| | | | | |
|---|---|---|---|---|
| FI | WO2013160554 | * | 10/2013 | E04B 9/04 |
| GB | 2182481 | A | 5/1987 | |
| WO | 2013066822 | A1 | 5/2013 | |

OTHER PUBLICATIONS

Armstrong, "Drywall Grid System", www.armstrong.com/commceilingsna/products/drywall-grid-systems/drywall-grid-systems/drywall-grid-system/_/N-IZ1z141hcZ1z141pj.
Armstrong, "Blades and Baffles", http://www.armstrong.com/commceilingsna/products/ceilings/blades-and-baffles/_/N- . . . .

* cited by examiner

LIGHT-EMITTING ACOUSTIC PANEL AND LIGHTING SYSTEM COMPRISING A SET OF SUCH PANELS

CROSS-REFERENCE TO PRIOR APPLICATIONS

This application is the U.S. National Phase application under 35 U.S.C. §371 of International Application No. PCT/EP2015/058012, filed on Apr. 14, 2015, which claims the benefit of European Patent Application No. 14166026.6, filed on Apr. 25, 2014. These applications are hereby incorporated by reference herein.

FIELD OF THE INVENTION

The invention relates to a light-emitting acoustic panel, and to a set of such panels forming a lighting system. The invention also relates to a lighting system comprising at least a first and a second set of panels.

BACKGROUND OF THE INVENTION

Sound absorbers in the form of panels arranged in a suspended manner from the ceiling of a room are well known in the art. The panels may by way of example be arranged in a parallel fashion suspended vertically from the ceiling. Also other patterns may be used, such as herring bone patterns. It is known with such panels having an integrated lighting where the lighting is arranged on the lower edge of the panels facing the floor, thereby providing the primary illumination of the room. The lighting source may by way of example be in the form of LED's.

EP-2180109 discloses a panel in the form of a foam part that can be suspended from a ceiling via a mounting rail to perform the function of a sound absorber. The foam part has two opposite side walls and a downwardly facing end face. The foam part further has a profiled portion that is associated with the side walls and with the downwardly facing end face. The profiled portion is formed to be open in the direction of the respective side wall, and extends over the entire length of the foam part. A lighting element in the form of a strip with LEDs is provided in each profiled portion. The LEDs directly illuminate the rear wall and the top of the profiled portion, and by virtue of reflection the light exits indirectly via the opening of the profiled portion, and diffusely through the downwardly facing end face of the foam part.

For the use in an office environment, it is desirable that the sound reducing capabilities of vertical panels work equally in all directions. For panels that are primarily oriented in one direction, such as in parallel rows, sound is optimally blocked in directions orthogonal to the panel orientation, i.e. orthogonally to the main surface of the panel. The sound blocking effect in a direction parallel to the panels is however low. Thus, for an office space with a more quadratic layout, such parallel suspended panels cannot provide an acoustic improvement for all transmission directions. To overcome these problems it is known to try to reduce the effect of the acoustic direction resulting from parallel panels by using so called checkerboard or herringbone patterns.

SUMMARY OF THE INVENTION

It is an object of the present invention to provide a set of panels forming a lighting system that allows integration of the lighting for the provision of indirect illumination.

Yet another object is to provide at least in part a set of panels that allow an omnidirectional acoustic absorption.

Still another object is to provide a lighting panel as such that allows an omnidirectional acoustic absorption.

According to a first aspect of the invention, these and other objects are achieved by a set of panels forming a lighting system, the set comprising a light-emitting panel and a light-reflecting panel, each panel having two opposing first sides, two opposing second sides and two opposing main surfaces, and each panel being suspended from a ceiling with a first side thereof facing the ceiling, the light-emitting panel comprising a light source arranged on a second side thereof, the second side of the light-emitting panel facing a main surface of the light-reflecting panel such that the light source is arranged to illuminate the main surface of the light-reflecting panel.

Thus, the panels in each set are arranged in a pattern in which the light-emitting panel being provided with the light source is arranged to face the main surface of the adjacent, second panel acting as the reflecting panel. The pattern may by way of example be a herringbone pattern or a checkerboard pattern. It goes without saying that when combining two or more sets of such panels, a panel constituting the light-emitting panel in a first set may constitute a reflecting panel when cooperating with a light-emitting panel of a second, adjacent set of panels. Thereby a mutual interaction between the panels in one and the same set, but also between the panels in adjacent sets is achieved. This allows the provision of an effective glare free light distribution. Also, an indirect illumination of the room may be achieved that in most situations will be experienced as comfortable and snug. Further, a homogenous illuminated ceiling surface is provided and the occurrence of dark regions within the system may be prevented.

By the term light source as used in the context of the application, the term should be construed as not being limited to one single light source but rather a luminescent area comprising at least one light source. The "solid angle" emitted by the light source, especially if a so called Lambertian emitter is used, may be arranged to cover essentially the whole major surface of the neighboring panel, i.e. the reflecting panel. This makes secondary optics superfluous and prevents a direct view into the light source. The "solid angle" emitted by a light source is generally defined as the surface area that is illuminated by the light source in case the light source is positioned in the center of a sphere with unit radius. In the context of the present application, the light source is approximated as a point source.

Accordingly, a cost effective solution for lighting integrated into panels with improved brightness or glare performance may be provided.

The light-emitting panel and the reflecting panel may be arranged in a staggered pattern. The light-emitting panel and the reflecting panel may by way of example be arranged in a staggered herringbone pattern or a staggered checkerboard pattern. Acoustical simulations have shown that compared to several reference arrangements, the arrangement according to the invention has a smaller radius of distraction, and therefore shows improved acoustical performance.

When mounted in a room, it is preferred that all panels are arranged with a well-defined inter-panel distance. Further, it is preferred that all panels are arranged with their main surfaces at an angle relative to the walls of the room that provides an optimal acoustical attenuation. The angle relative to the wall is preferably an oblique angle such as 45 degrees.

The light-emitting panel may comprise a light source arranged on both opposing second sides thereof. Thereby a light-emitting panel forming part of a first set of panels may be used to illuminate not only the reflecting panel forming part of the first set of panels but also the reflecting panel forming part of an adjacent, second set of panels. Thereby, it is made possible to easily arrange a plurality of sets of panels in a desired pattern covering the available ceiling area of a room.

At least one of the light-emitting panel and the light-reflecting panel may comprise a light source on one of their opposing first sides. Such light source is preferably arranged on the first side arranged to be face away from the ceiling when the panel are suspended from the ceiling. Thereby, such light source may function as the primary illumination of the room.

The light-emitting panel and the light-reflecting panel may be acoustic. By the panels being made of an acoustic material in combination with the panels being suspended from the ceiling in a pattern with the second side of the light-emitting panel facing a main surface of the light-reflecting panel, the panels will confine the sound in the room in two directions as opposed to only one direction which would be the case if the panels are arranged in a parallel pattern.

The light source may be a LED-based light source. It is to be understood that the light source may be integrated with the light-emitting panel or may be arranged thereto as a module.

The light-emitting panel in a first set of panels may be arranged to constitute a reflecting panel in a second set of panels, the second set of panels comprising a light-emitting panel and a light-reflecting panel.

The main surface of the light-reflecting panel being arranged to be illuminated by the light source arranged on the light-emitting panel may have light diffusing properties. Such properties may be used to reduce any glare and also to provide a feeling of a more comfortable and snug experience by a viewer.

The second side of the light-emitting panel provided with a light source may be provided with a diffuser. The diffuser may by way of example be in the form of lamellas or a grid structure. By using lamellas or a grid structure, the viewer will be prevented from looking directly into the light source.

The diffuser may be a diffusing screen. The distance between the diffusing screen and the light source may be at least 50 mm. The diffusing screen may be a textile material or any other fibrous material. It may also be an opaque plastic material.

The main surface of the light-emitting panel may be arranged with an angle of 45 to 90 degrees in view of the main surface of the light-reflecting panel.

According to another aspect, the invention may relate to a lighting system comprising at least a first and a second set of panels according to any of the features previously discussed, wherein the panels in the first set of panels and the second set of panels are arranged in a herringbone pattern, in which pattern the light-emitting panel of the first set of panels is arranged to constitute a light-reflecting panel when being illuminated by the light-emitting panel of the second set of panels. The herringbone pattern may be a staggered herringbone pattern.

As another alternative, the panels in the first set of panels and the second set of panels may be arranged in a checkerboard pattern, in which pattern the light-emitting panel in a first set of panels is arranged to illuminate the light-reflecting panel in the first set of panels and the light-reflecting panel in the second set of panels, and wherein the main surface of the light-emitting panel in the first set of panels is arranged essentially in parallel with the main surface of the light-emitting panel in the second set of panels, while the main surface of the light-reflecting panel in the first set of panels is arranged essentially in parallel with the main surface of the light-reflecting panel in the second set of panels. The checkerboard pattern may be a staggered checkerboard pattern.

According to another aspect of the invention, an acoustic panel having two opposing main surfaces, two opposing first sides and two opposing second sides, the acoustic panel further comprising: a suspending member for suspending the acoustic panel from a ceiling, the suspending member being arranged on one of the first sides such that when the acoustic panel is suspended from the ceiling the two opposing main surfaces are arranged perpendicular to the ceiling, and a light source arranged on one of the second sides such that when the acoustic panel is suspended from the ceiling the light source is arranged to provide illumination in a main direction, the main direction being parallel to the ceiling and perpendicular to the normal of the main surfaces.

Such acoustic panel presents in all relevant aspects the same advantages as those discussed above in view of the system and to avoid undue repetition, reference is made to the previous paragraphs.

It is noted that the invention relates to all possible combinations of features recited in the claims.

BRIEF DESCRIPTION OF THE DRAWINGS

These and other aspects of the present invention will now be described in more detail, with reference to the appended drawings showing embodiments of the invention.

It should be stressed that the appended drawings are for illustrative purposes and, are thus provided to illustrate the general structures of embodiments of the present invention. Like reference numerals refer to like elements throughout.

DETAILED DESCRIPTION OF THE EMBODIMENTS

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Figure 1:
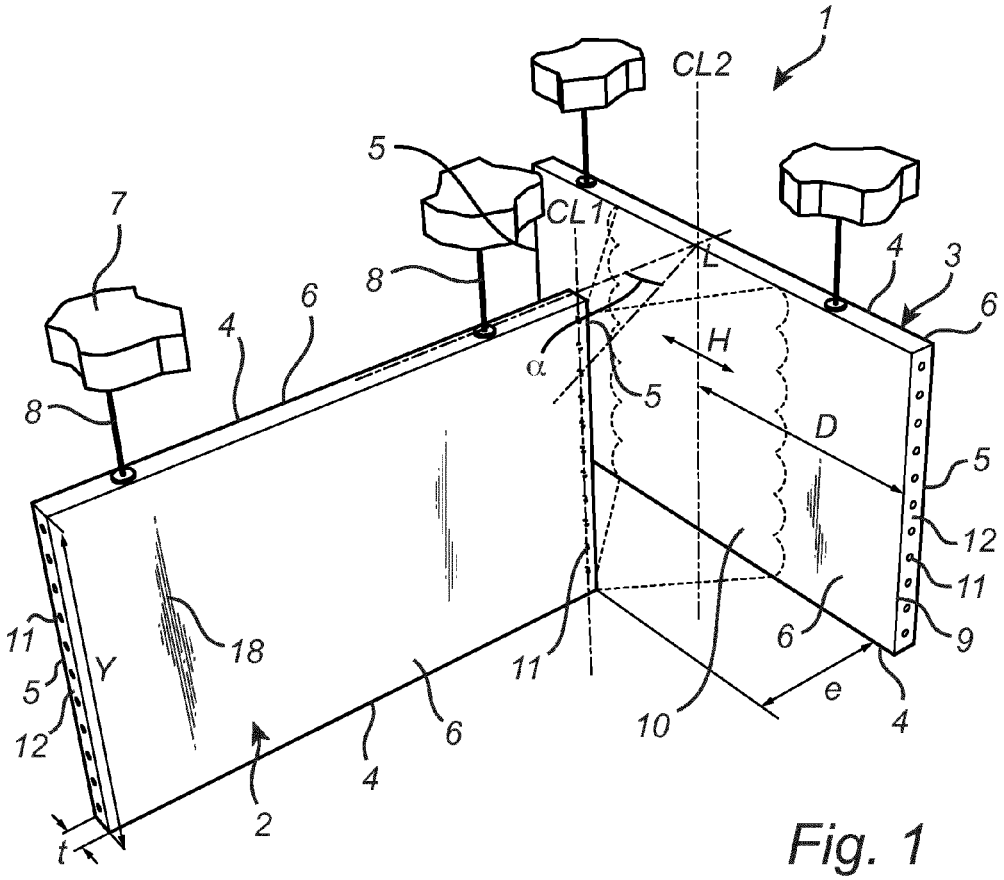
FIG. 1 discloses one embodiment of a set of panels.

Referring to FIG. 1 one embodiment of a set 1 of panels forming a lighting system according to the invention is disclosed.

The set 1 comprises a light-emitting panel 2 and a light-reflecting panel 3. Each panel 2, 3 has in its most general form a rectangular geometry in the form of two opposing first sides 4, two opposing second sides 5 and two opposing main surfaces 6. It is to be understood that also other geometries but rectangular are applicable within the scope of the invention.

The panels 2, 3 preferably have a uniform thickness with the thickness t to be interpreted as the distance between the two opposing main surfaces 6.

The panels 2, 3 are arranged to be suspended from a ceiling 7 like baffles with one of the first sides 4 thereof facing the ceiling 7. The panels 2, 3 may be suspended by hanging freely in wires 8 or chains extending from the ceiling 7. The panels 2, 3 may also be suspended by being fixedly mounted in fixtures (not shown). The fixtures may by way of example be in the form of rails. Thus, the panels 2, 3 are suspended in a generally vertical manner. The invention is applicable even if the panels 2, 3 should be suspended with their main surfaces 6 forming an angle in view of the vertical plane.

In their easiest form, the panels 2, 3 are provided with straight edges, although it is to be understood that their edge portions may be profiled.

The light-emitting panel 2 is provided with a light source 11 on its second side 5 intended to be facing the light-reflecting panel 3. The light source 11 may as illustrated be arranged on both opposing second sides 5. In the latter case, the light-emitting panel 2 in a first set of panels may illuminate the light-reflecting panel 3 included in the same set of panels, but also a panel, no matter if it as such is a light-emitting panel or a light-reflecting panel, in a second adjacent set of panels. No matter design, the light source 11 is preferably seamlessly integrated in the second side. When the acoustic panel 2; 3 is suspended from the ceiling 7 the light source 11 is arranged to provide illumination in a main direction that is parallel to the ceiling 7 and perpendicular to the normal of the main surfaces 6.

The term light source 11 should be construed as not being limited to one single light source but rather a luminescent area 12 comprising at least one light source. The light source 11 may by way of example be a LED based luminaire. The luminescent area 12 may be arranged by solitaire LED's or arranged as arrays with a plurality of LED's. In the illustrated embodiment the luminescent area 12 is provided as a strip with a plurality of LED's.

The light sources 11 may be so called Lambertian emitters, meaning that the emitter radiates according to the Lambert's cosine law, which states that the radiance of certain idealized surfaces depends on the viewing angle of the surface. The radiant intensity is maximum normal to the surface and decreases in proportion to the cosine of the angle from the normal.

By using Lambertian emitters, the solid angle covered by such emitter may be arranged to form an illuminated area 10 covering essentially the whole main surface 6 of the neighboring panel, i.e. the reflecting panel 3. This makes secondary optics superfluous and prevents a direct view into the light source 11.

The luminescent area 12 of the second side 5 of the panels 2, 3 may be dimensioned based on the lumen output from the light source 11. The luminescent area 12 may extend along the full longitudinal extension Y of the second side 5 or only along a fraction thereof. In the latter case the luminescent area 12 is preferably positioned in a mid-portion of the second side 5.

The light source 11 may be integrated with the second side 5 of the light-emitting panel 2 or be in the form of a light module to be attached thereto.

The light source 11 may be dimmable.

Figure 2:
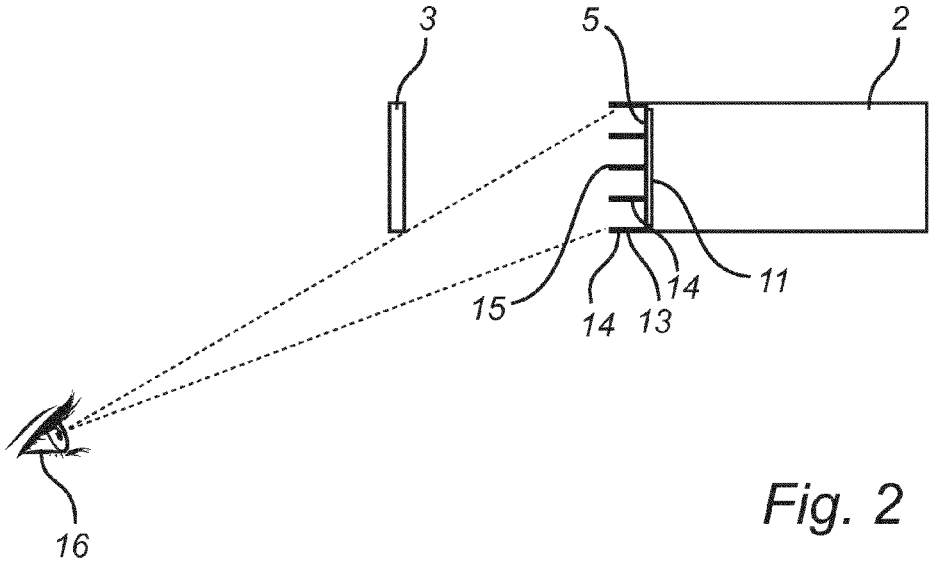
FIG. 2 discloses highly schematically one example of a set of panels, wherein the second side of the light-emitting panel is provided with a diffuser in the form of lamellas.

The second side 5 of the panels 2, 3 being provided with a light source 11 may be provided with a diffuser 13. One such example is disclosed in FIG. 2. The diffuser 13 is arranged in the form of a plurality of lamellas 14. The light source 11 is arranged in a recessed position in view of the outer most edge 15 of the lamellas 14. Further, the lamellas 14 are horizontally oriented. The lamellas 14 may be used to improve the glare performance in case the luminance is too bright.

Also, by the recessed position of the light source 11, the observer 16 will be prevented from looking directly into the light source 11 and thereby risking getting disturbed thereby.

Figure 3:
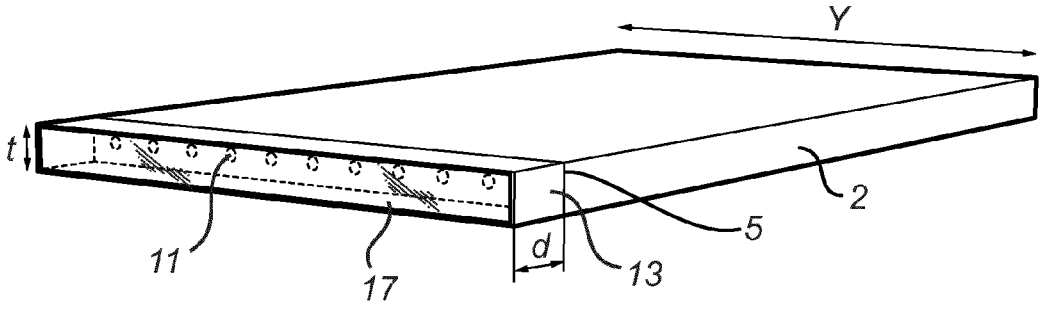
FIG. 3 discloses highly schematically one example of a light-emitting panel provided with a diffuser in the form of a diffusing screen.

Yet another embodiment of a diffuser 13 is illustrated in FIG. 3. The diffuser 13 takes the form of a diffusing screen 17 which is arranged to extend across the light source 11. The diffusing screen 17 may be arranged at or be integrated with the second side 5 of the light-emitting panel 2. In order to obtain an uniform luminance, the distance between the light source and the diffusing screen should be sufficient large. By way of examples, trials have shown that in case of a panel having a thickness t of 40 mm and a longitudinal extension Y of 300 mm, where the second side 5 is provided with a Fortimo® LED line, a suitable distance d between the light source 11 and the diffusing screen 17 could be 50-100 mm. It is to be understood that the distance d depends on e.g. the material of the diffusing screen 17 and its transparency. The diffusing screen 17 may by way of example be made of woven textile or other fibrous web material or an opaque plastic material.

Now a new turning to FIG. 1, the panels 2, 3 included in a set of panels 1 are arranged in staggered pattern. By a staggered pattern is meant that the vertical center line CL1 as seen in the thickness t direction of the second side 5 of the light-emitting panel 2 is horizontally displaced D along the main surface 6 of the reflecting panel 3 and in view of a vertical edge portion 9 of the reflecting panel 3. The vertical center line CL1 of the light-emitting panel 2 should be horizontally displaced D to such extent in view of the vertical edge portion 9 of the reflecting panel 3 that the illuminated area 10 on the reflecting panel 3 illuminated by the light source 11 on the light-emitting panel 2 is fully projected at least as seen in the horizontal direction H on the main surface 6 of the reflecting panel 3. The illuminated area 10 on the reflecting panel 3 will accordingly be symmetrical as seen along the thus projected vertical center line CL1. In the illustrated example the projected vertical center line CL1 coincides with the vertical center line CL2 of the reflecting panel 3. It is to be understood that the required horizontal displacement D depends on the luminary power of the light source 11 of the light-emitting panel 2, the distance e between the second side 5 of the light-emitting panel 2 and the main surface 6 of the reflecting panel 3 and the desired luminance on illuminated area 10 on the reflecting panel 3.

Figure 9A:
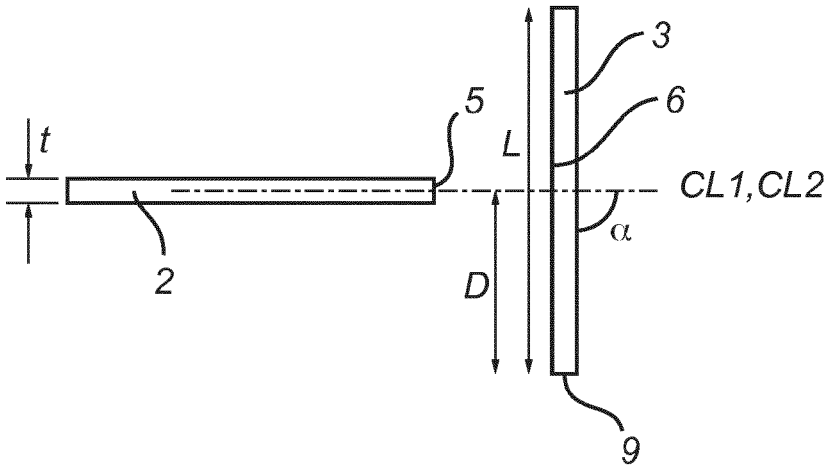
FIGS. 9*a* to 9*c* illustrate different degrees of staggering.
Figure 9B:
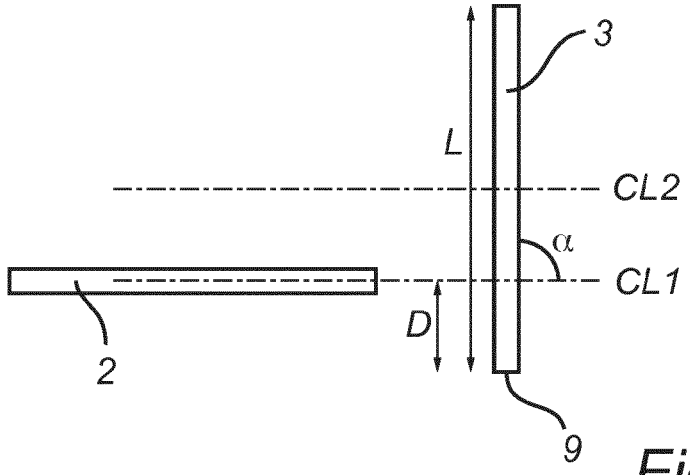
Figure 9C:
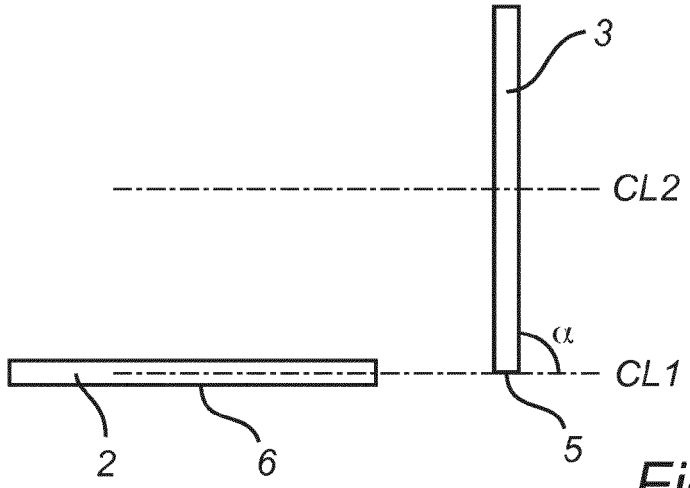

Now turning to FIGS. 9*a* to 9*c*, three different examples are given to further illustrate staggering and different degrees thereof. FIG. 9*a* illustrates a first example wherein the staggering is 100%. In the 100% staggering, i.e. full staggering, the vertical center line CL1 of the light-emitting panel 2 as seen in the thickness t direction of the second side 5 of the light-emitting panel 2 coincides with the vertical center line CL2 of the main surface 6 of the reflecting panel 3. Thus, the vertical center line CL1 of the light-emitting panel 2 is horizontally displaced a distance D corresponding to 50% of the total length L of the reflecting panel 3 as seen from the vertical edge portion 9 of the reflecting panel 3.

FIG. 9*b* illustrates an example of a 50% staggering. In the 50% staggering, the vertical center line CL1 of the light-emitting panel 2 is displaced a distance D corresponding to 25% of the total length L of the reflecting panel 3 as seen from the vertical edge portion 9 of the reflecting panel 3.

FIG. 9*c* illustrates a non-staggered embodiment, also known as a flushed herringbone pattern. In the flushed herringbone pattern, the vertical center line CL1 of the light-emitting panel 2 is arranged essentially in line with the second surface 5 and thereby the vertical edge portion 9 of the reflecting panel 3. Thus, the distance D is zero.

The main surface 6 of the light-emitting panel 2 may be arranged with an angle $\alpha$ of 45 to 90 degrees in view of the main surface 6 of the light-reflecting panel 3. In the disclosed embodiments of FIGS. 1 and 9*a* to 9*c*, the angle $\alpha$ is 90 degrees, i.e. the main surfaces 6 of the panels 2, 3 are orthogonally arranged.

The panels 2, 3 are preferably made of an acoustic material such as high density glass wool or stone wool. It is to be understood that also other types of materials may be possible.

Depending on the intended properties and the intended use, at least the main surface 6 of the reflecting panel 3 in the set of panels 1, intended to face the second side 5 of the light-emitting panel 2 may exhibit light diffusing properties. This may be made by using a light diffusing surface layer or a light diffusing coating. By light diffusion is meant how light is spread. The more diffusely and evenly the light is spread, the better dazzle and glare are prevented. Light diffusion can be defined as the ratio of the diffused reflected light to the totally reflected light.

Figure 4:
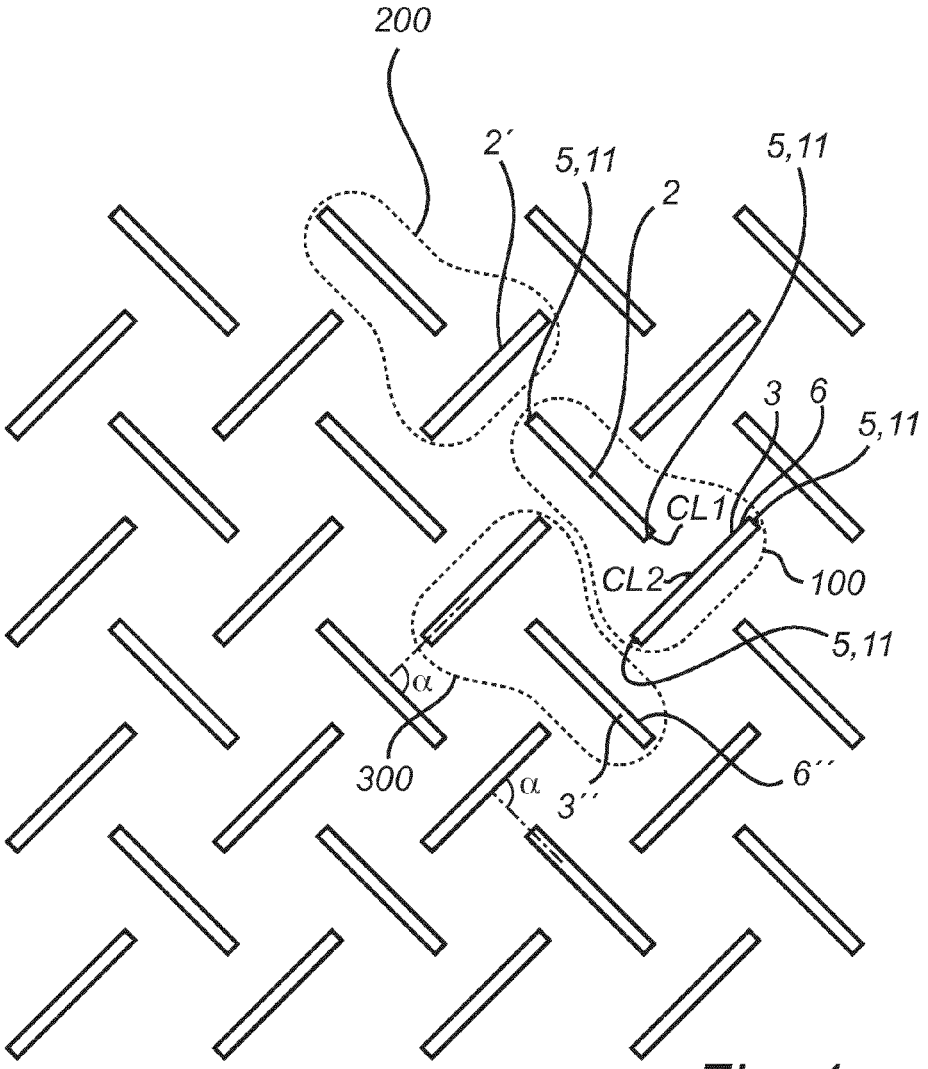
FIG. 4 discloses one example of a staggered herringbone pattern.

Now turning to FIG. 4, a first set of panels 100 is disclosed combined with a plurality of sets 200, 300 of similar panels in a staggered herringbone pattern. In the disclosed embodiment, the panels are arranged with a staggering of 100%, meaning that the vertical center line CL1 of the light-emitting panel 2 in the first set of panels 100 coincides with the vertical center line CL2 of the main surface 6 of the reflecting panel 3 in said first set of panels 100. The main surfaces 6 of the light-emitting panel 2 and the reflective panel 3 respectively in each set of panels 100, 200, 300 are arranged with an angle $\alpha$ in view of each other. In the disclosed embodiment the angle $\alpha$ is set to 90 degrees, i.e. the main surfaces are orthogonally arranged. It is to be understood that also other angles $\alpha$ are applicable. It is preferred that the angle $\alpha$ is set to 45 to 90 degrees.

Provided the light-emitting panel 2 in the first set of panels 100 is provided with a light source 11 in both its second sides 5, the light-emitting panel 2 will illuminate the reflecting panel 3 in the first set of panels 100 but also illuminate the reflecting panel 2' in a second adjacent set of panels 200. Likewise, by the reflecting panel 3 in the first set of panels 100 also being provided with light sources 11 in both its second sides 5, the reflecting panel 3 will also operate as a light-emitting panel illuminating the main surface 6" of a panel in a third, adjacent set of panels 300 which panel thereby will act as an reflecting panel 3". Accordingly, one and the same panel may have a dual function: it will act as a light-emitting panel 2, 2', and a light-reflecting panel 3, 3".

By the staggered herringbone pattern, noise that inevitable will be generated in a room will be subjected to an omnidirectional acoustic absorption, i.e. the sound will be confined in two directions as opposed to only one direction which would be case if the panels were arranged in parallel rows. The acoustic absorption may be enhanced by making the panels of an acoustic material.

Provided the light source is of the Lambertian emitter type, the solid angle covered by such light may cover the full main surface of the reflecting panel. This will make any secondary optics superfluous and also prevent any direct view into the light source, making it resilient against glare. This can be considered a cost-effective solution for lighting integrated into baffles, with improved brightness/glare performance.

Figure 5:
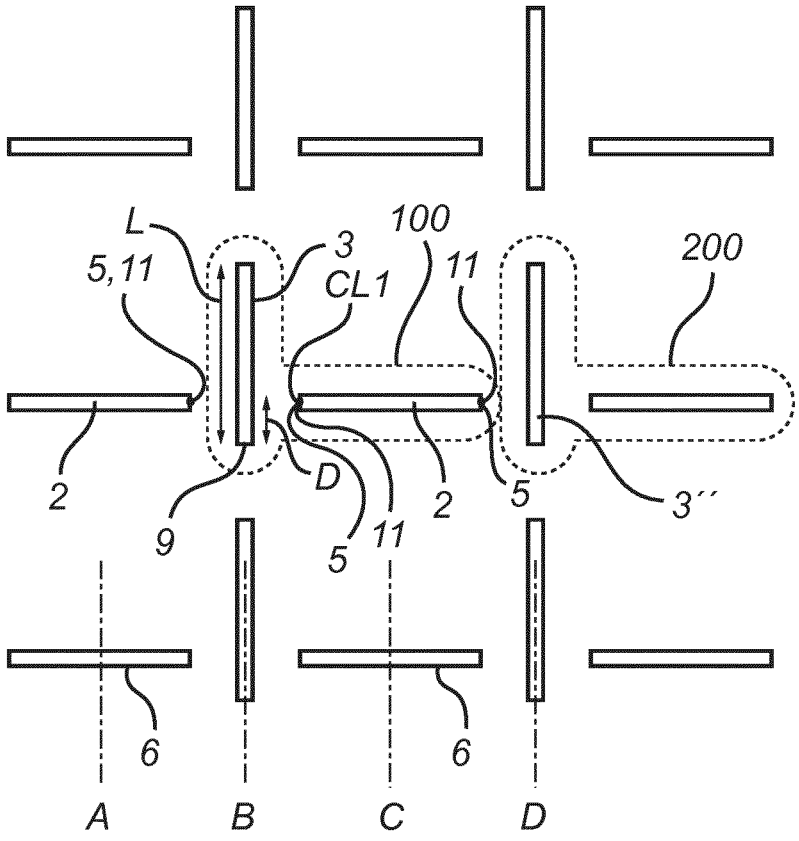
FIG. 5 discloses one example of a staggered checkerboard pattern.

Now turning to FIG. 5, a first set of panels 100 is disclosed combined with a plurality of additional sets of similar panels in a so called checkerboard pattern. In the disclosed example, the panels are arranged with a staggering of 50%. Thus, the vertical center line CL1 of the light-emitting panel 2 is displaced a distance D corresponding to 25% of the total length L of the reflecting panel 3 as seen from the vertical edge portion 9 of the reflecting panel 3.

In a checkerboard pattern, the panels are arranged in rows A, B, C, D etc. The panels in rows A and C etc. are oriented with their main surfaces 6 in line with each other whereas the panels in rows B and D etc. are oriented with their main surfaces 6 in line with each other but orthogonally to the main surfaces 6 of panels in adjacent rows A, C etc.

In the checkerboard pattern, the panels in one and the same row A, B, C, D etc. are preferably of one and the same type, i.e. either of the light-emitting type 2 having light sources 11 arranged on both opposing second sides 5 or of the light-reflecting type 3 adapted to be illuminated by illuminating panels 2 in adjacent rows. Accordingly, in the disclosed example, the light-emitting panel 2 of the first set of panels 100 is arranged in row C whereas the light receiving panel 3 in the same set of panels is arranged in adjacent row B. Also, the light-emitting panel 2 in the first set of panels 100 will illuminate not only the light-reflecting panel 3 in its own set but also the light-reflecting panel 3" of a second adjacent set of panels 200 arranged in row D.

Just like for the staggered herringbone pattern, noise that inevitable will be generated in the room will by the staggered checkerboard pattern be subjected to an omnidirectional acoustic absorption. The acoustic absorption may be enhanced by making the panels of an acoustic material.

Figure 6A:
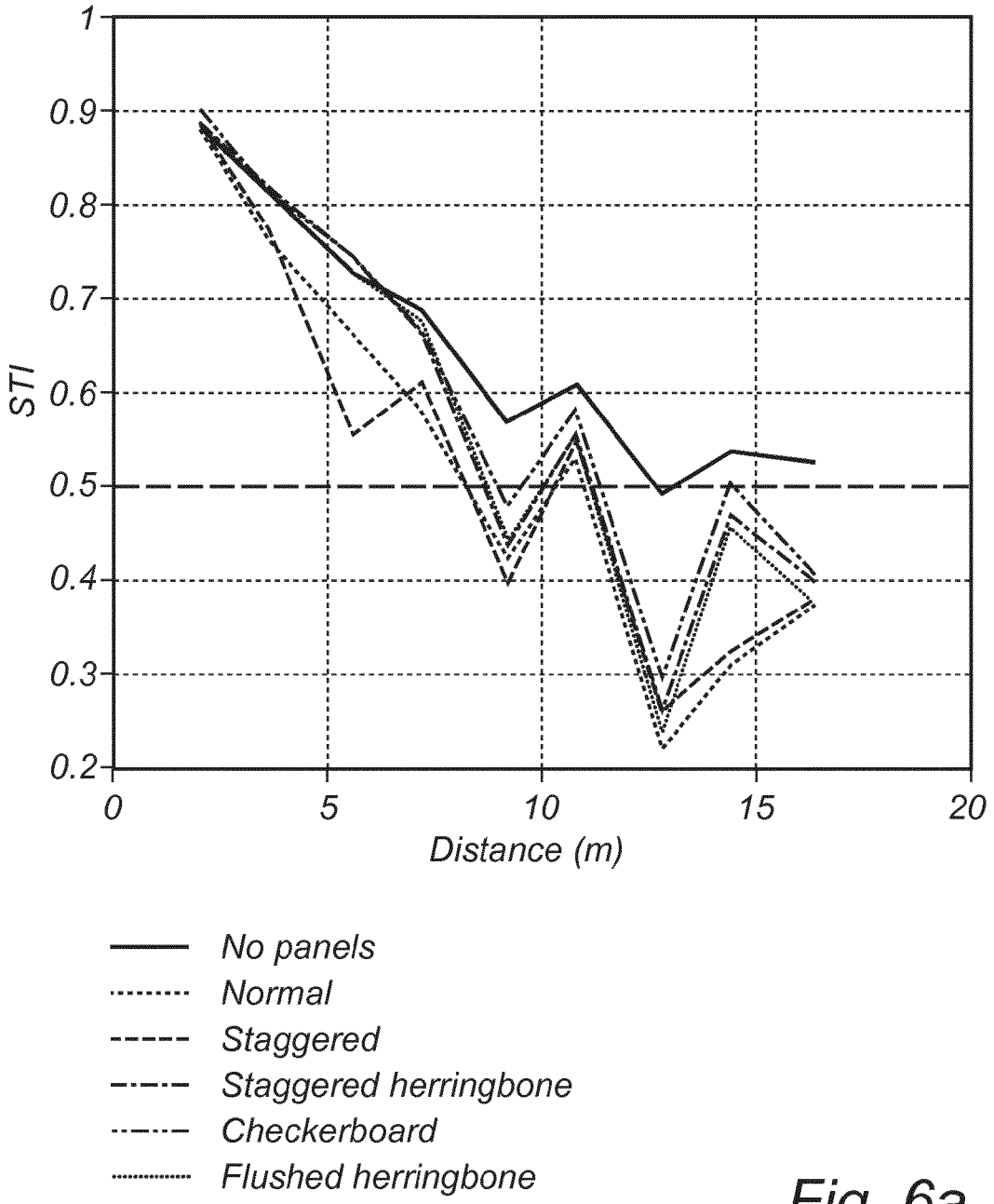
FIGS. 6*a* to 6*c* represent three graphs presenting measurements of the so called Speech Transmission Index for a number of different patterns.
Figure 6B:
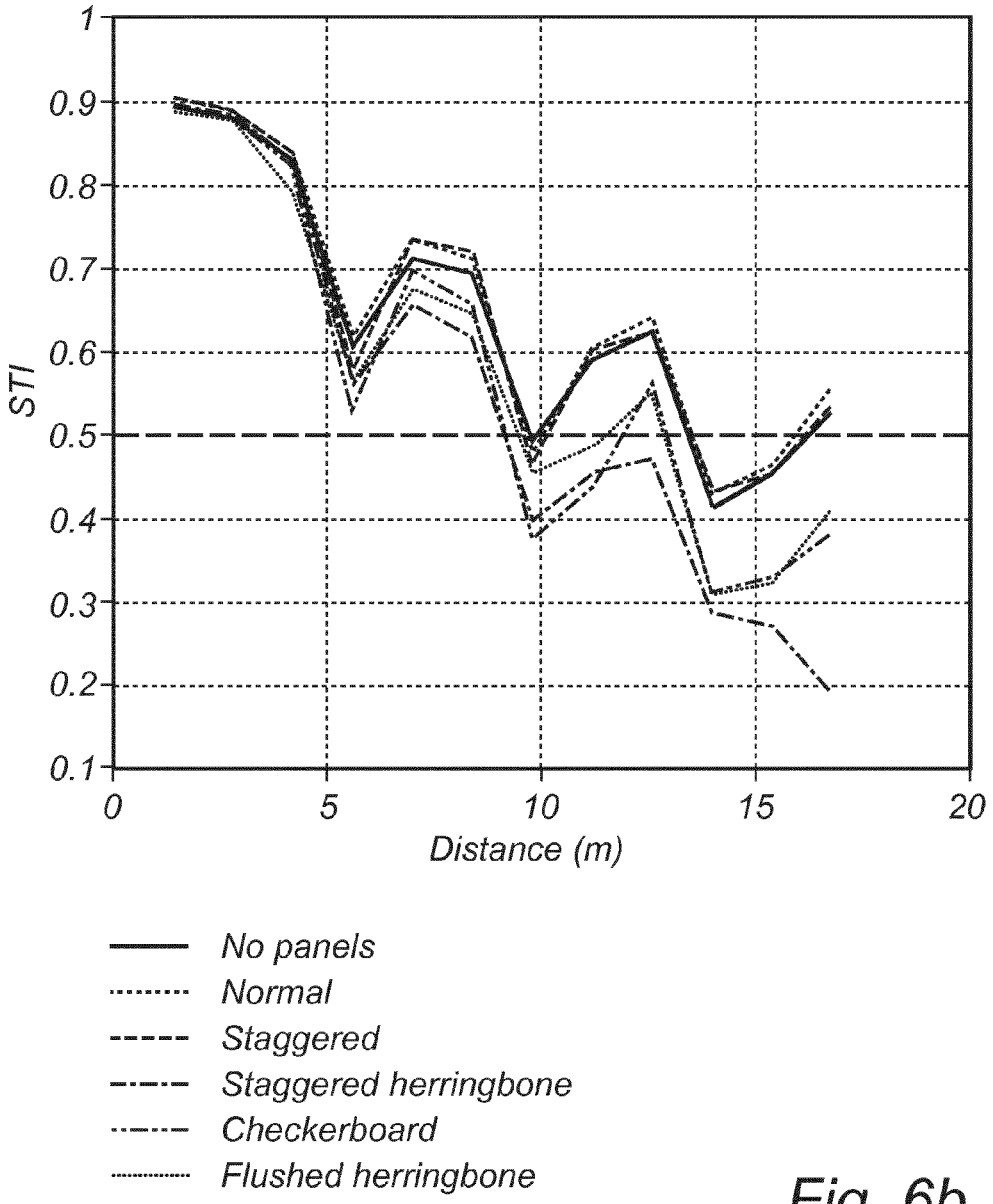
Figure 6C:
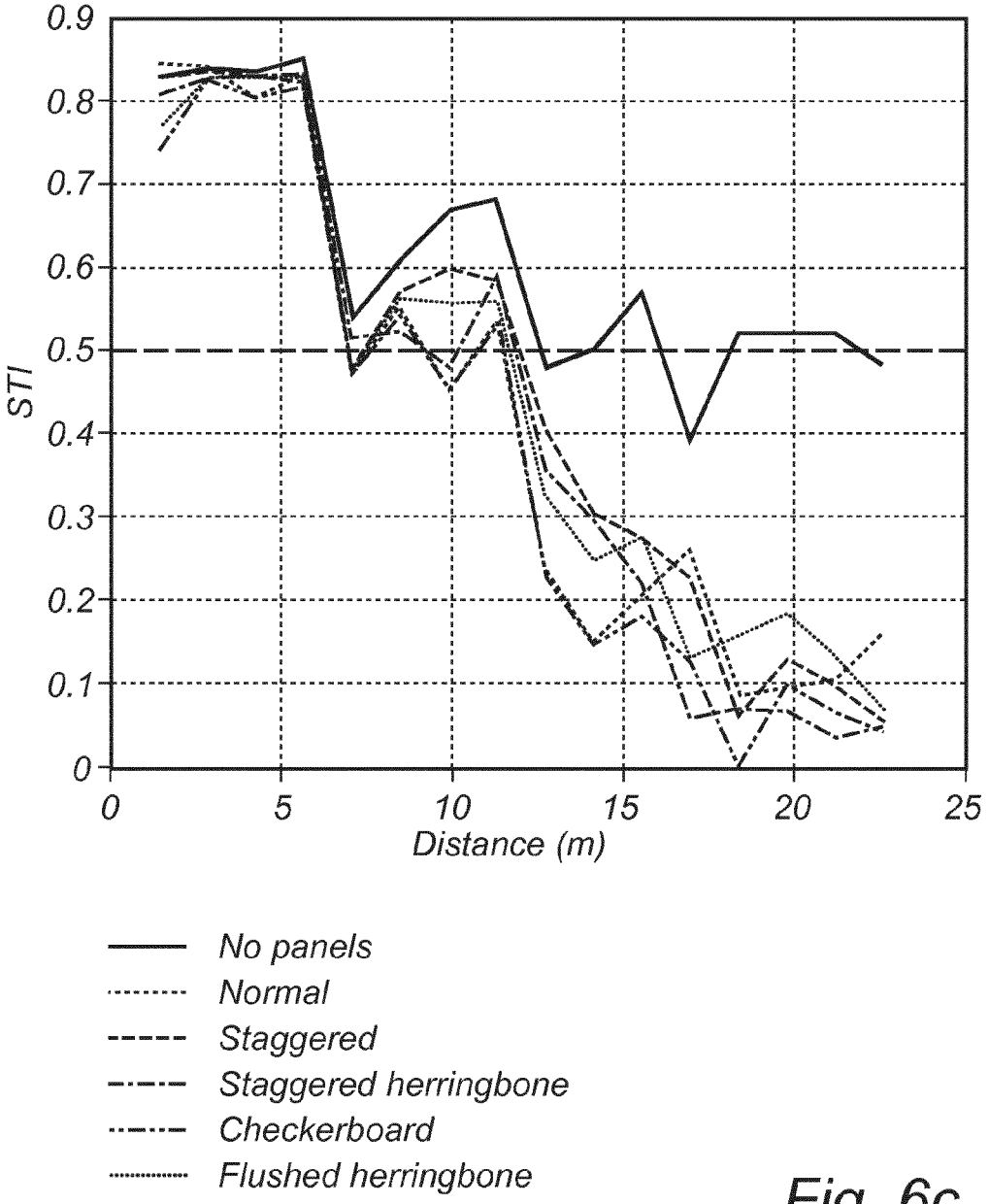

Now turning to FIGS. 6*a* to 6*c* three graphs are disclosed representing measurements of the so called Speech Transmission Index (STI) for a number of different patterns.

The Speech Transmission Index represents a well-known way of measuring speech intelligibility in an objective manner. The measurements are made by placing a loudspeaker, which transmits sound from the location of the person speaking, and a microphone where the listeners are situated. All octave bands in the frequency range 125 to 8000 Hz are measured. The index is frequently used since it is directly dependent on the level of background noise, reverberation time and the shape of the room.

In the measurements, six different panel patterns were simulated acoustically. A square office of the floor surface 20×20 meters with 50 work places was simulated. The total number of panels included was 154, corresponding to a panel surface of 222 $m^2$. The background noise level was set to 38.8 dBA which is a typical level in an (empty) office.

Figure 7A:
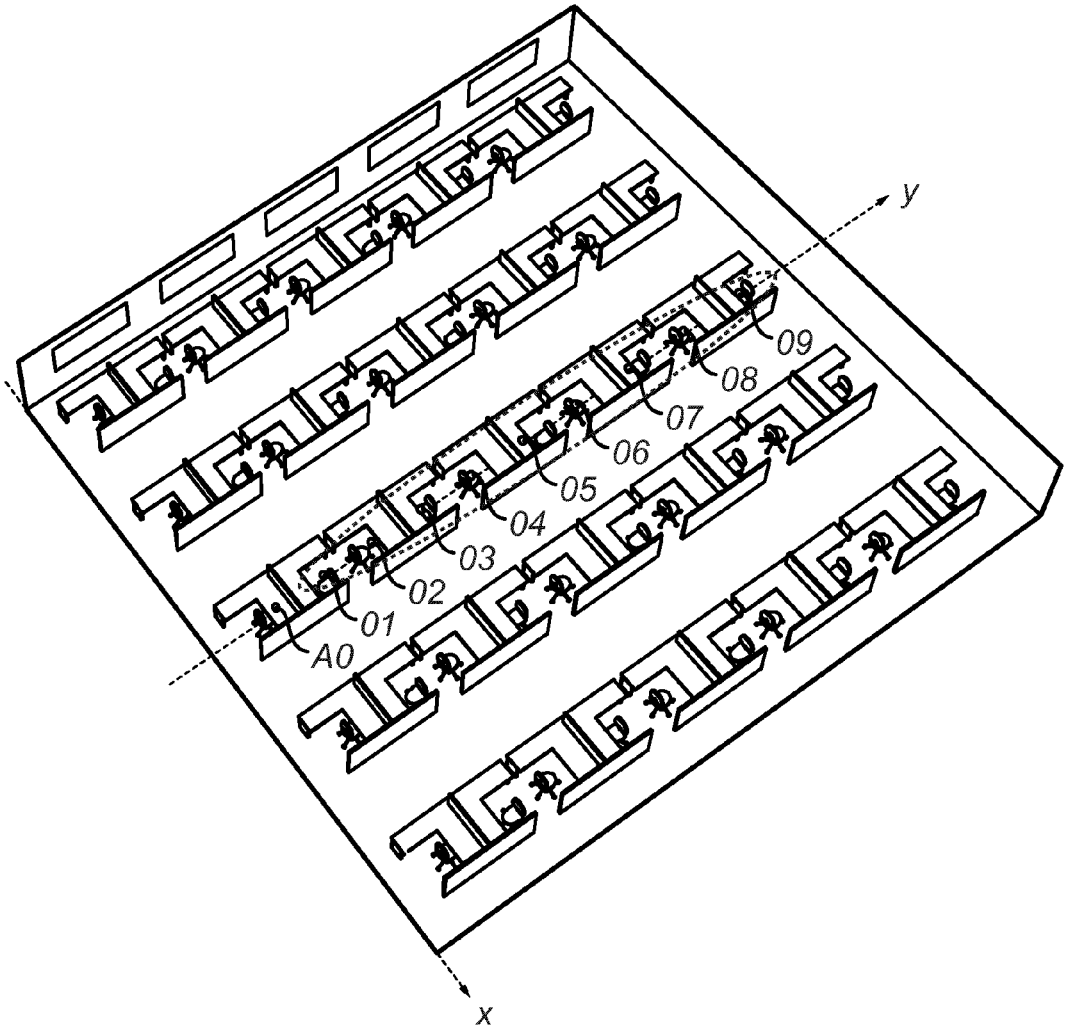
FIGS. 7*a* to 7*c* illustrate three different measurement positions represented by lines A-C.
Figure 7B:
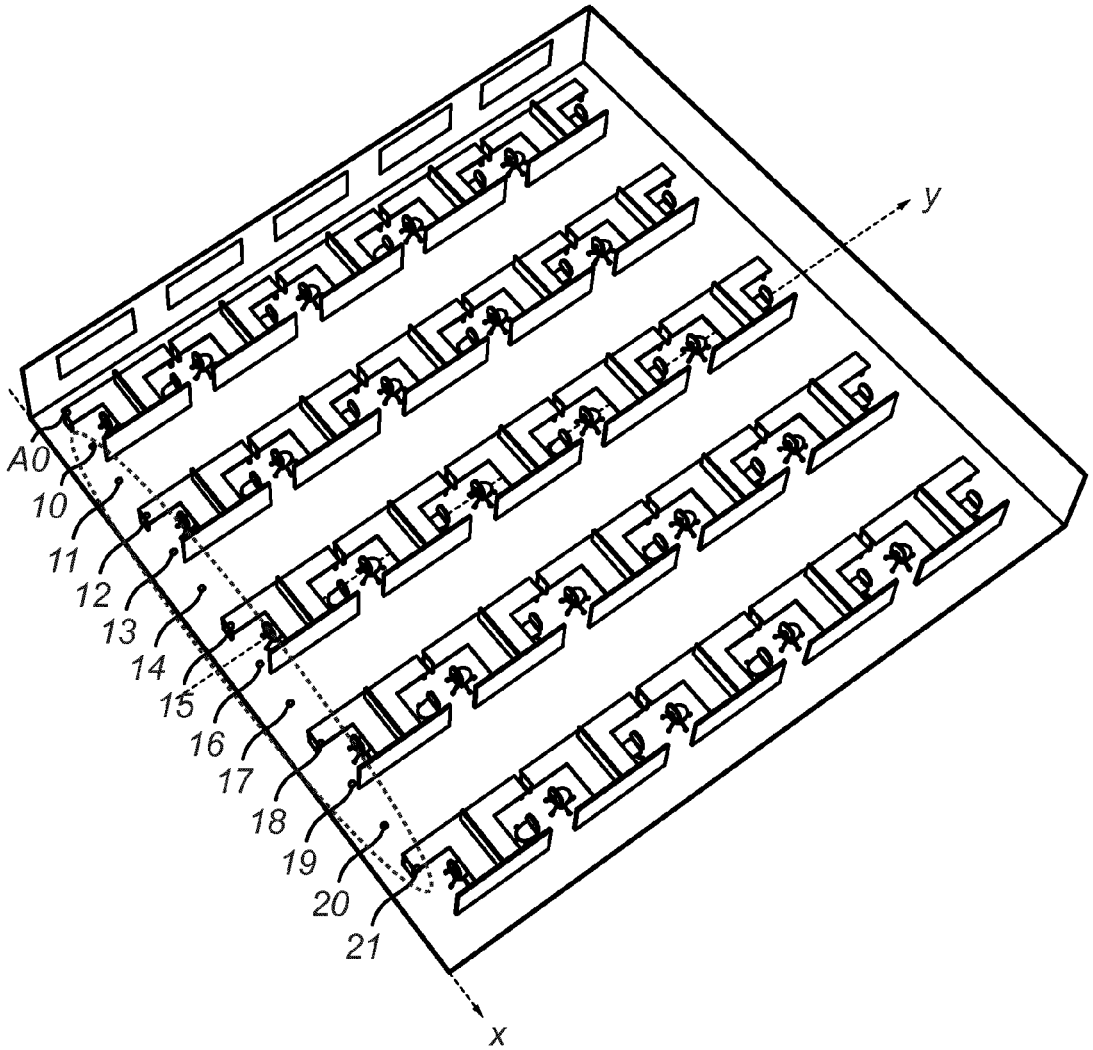
Figure 7C:
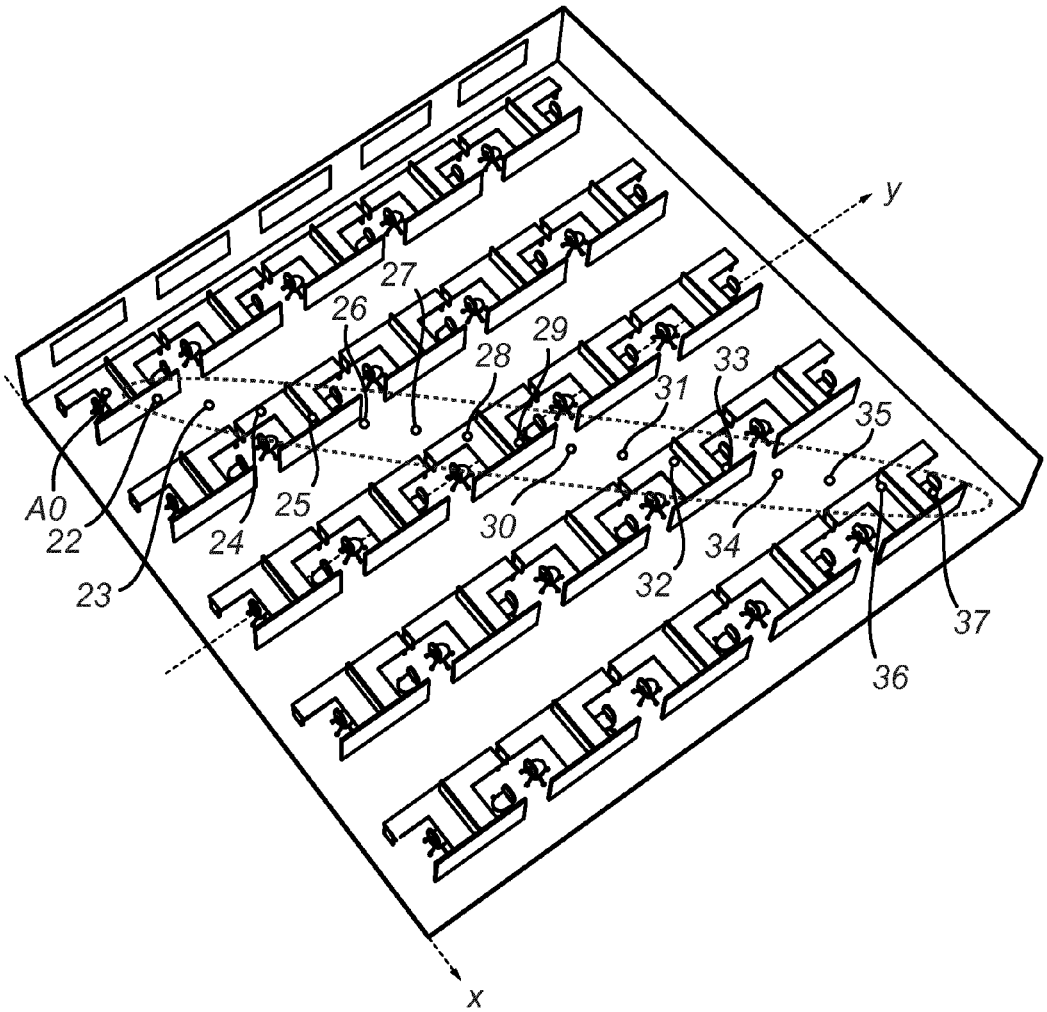
Figure 8A:
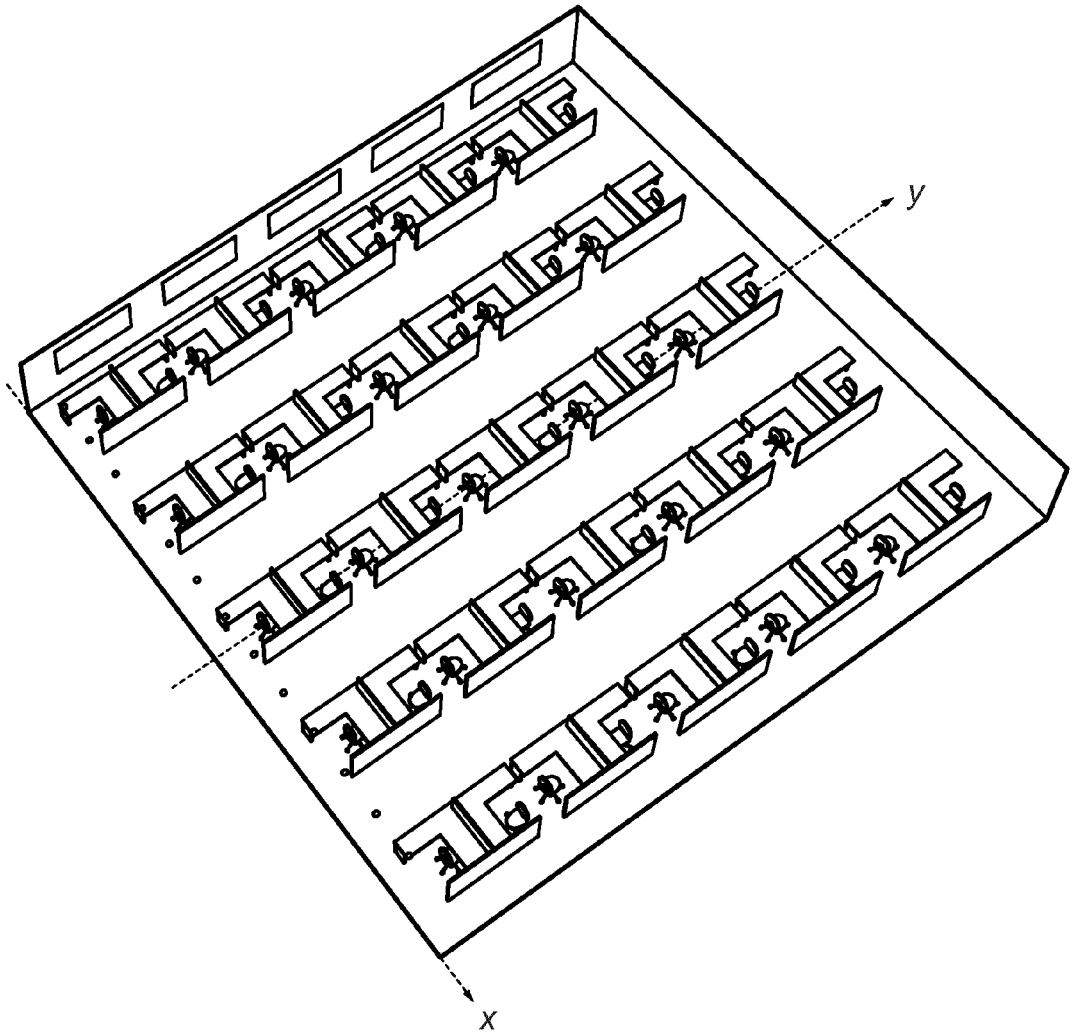
FIGS. 8*a* to 8*f* illustrate different panel patterns for the measurements.
Figure 8B:
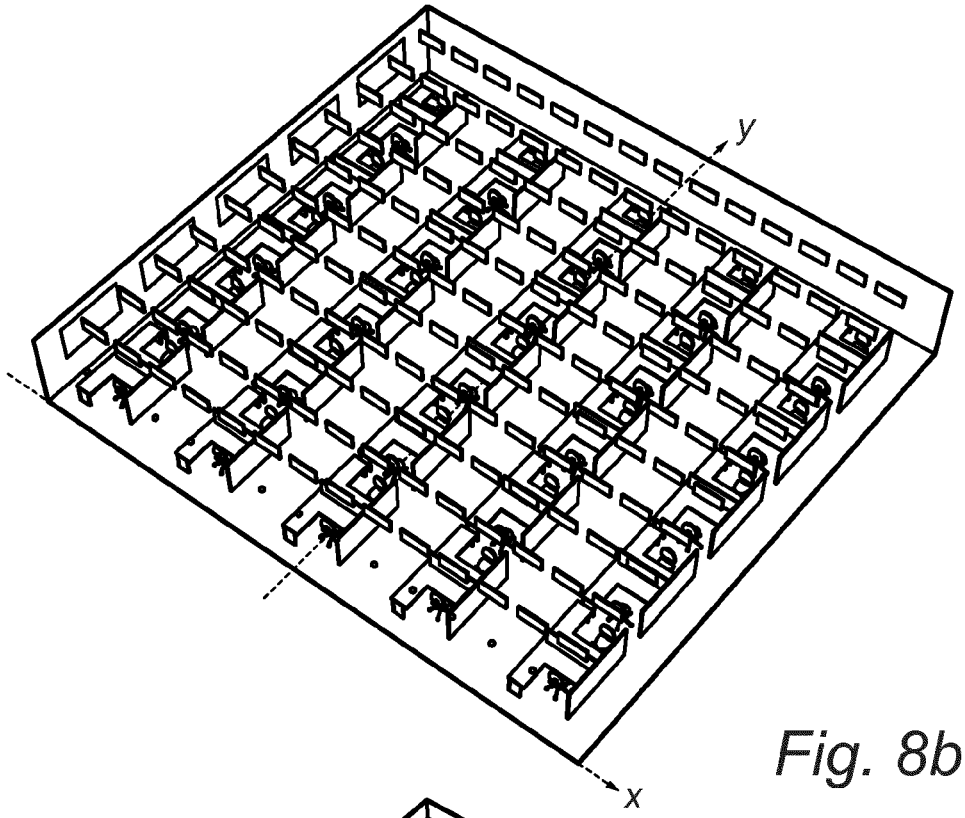
Figure 8C:
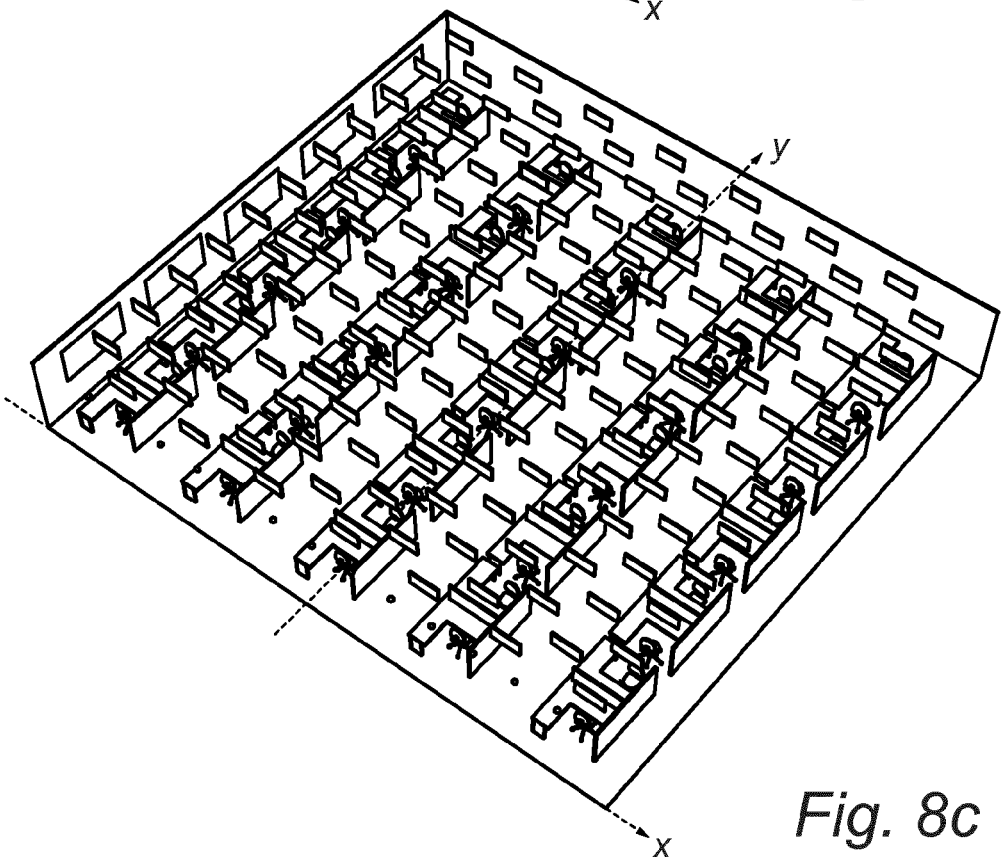
Figure 8D:
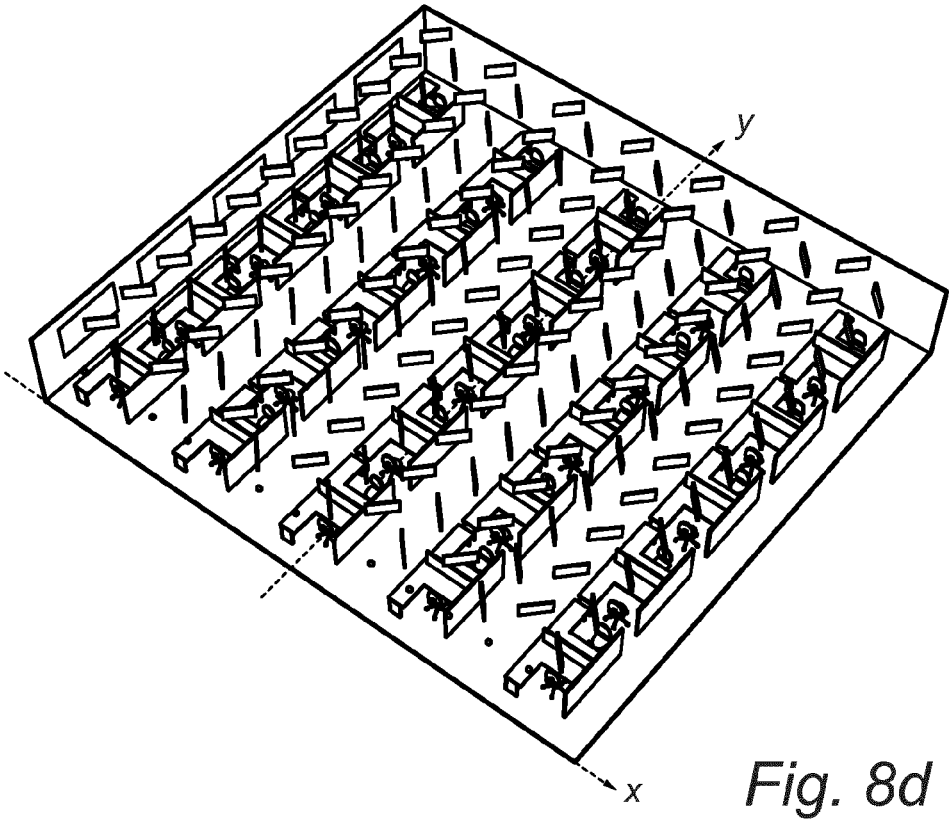
Figure 8E:
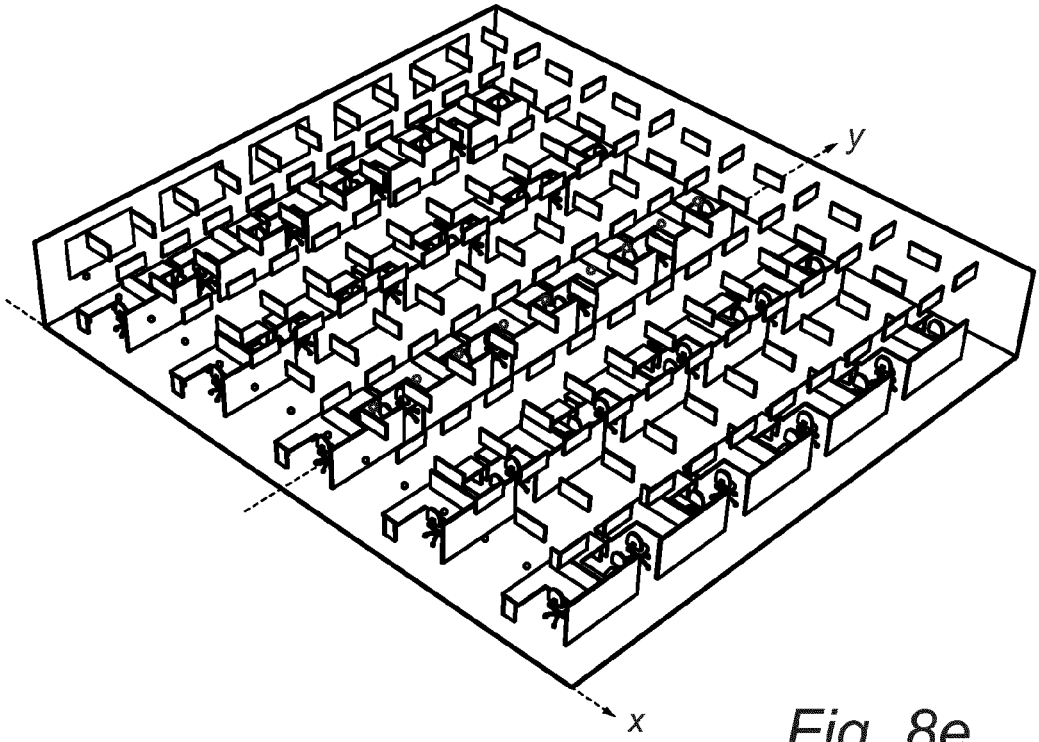
Figure 8F:
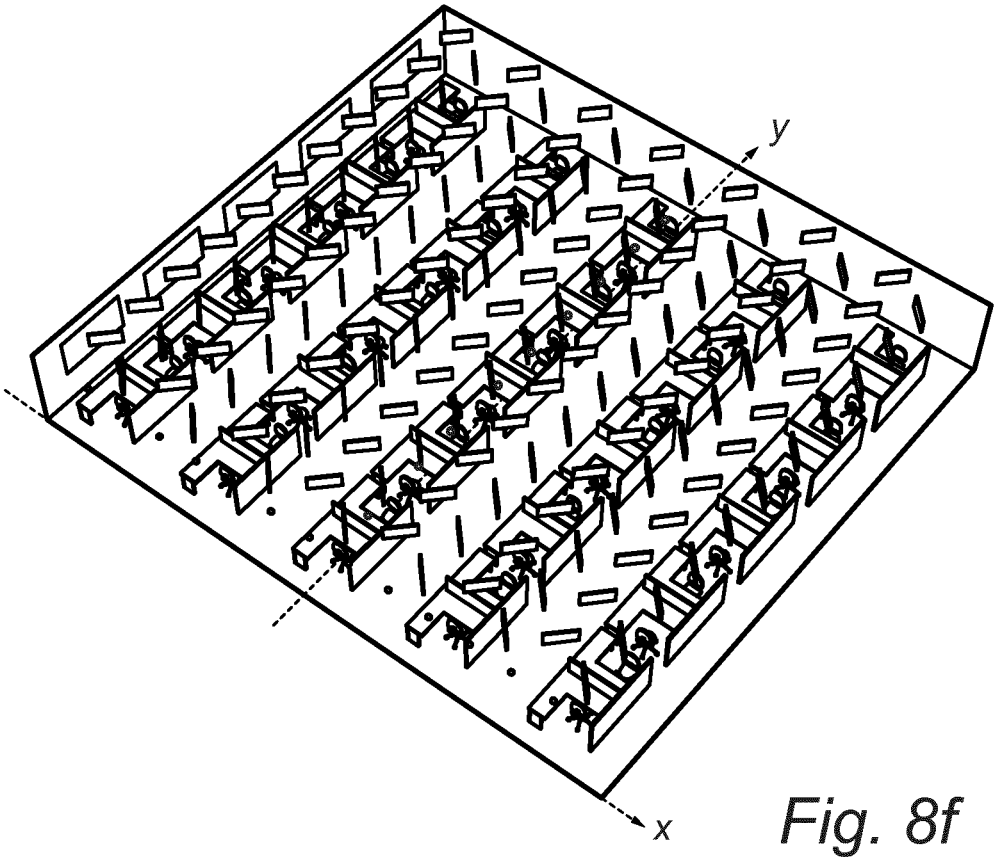

The source and the receivers were used in three different measurement positions, represented by line A (illustrated in FIG. 7*a*), line B (illustrated in FIG. 7*b*) and line C (illustrated in FIG. 7*c*). Further, the different tested panel layouts are illustrated in FIGS. 8*a* to 8*f*). FIG. 8*a* illustrates a situation with no panels present. FIG. 8*b* illustrates a normal panel setup with the panels being arranged in a plurality of parallel lines. FIG. 8*c* illustrates a panel setup with the panels being arranged in a plurality of parallel lines where the panels in one line are staggered in view of the panels in adjacent lines. FIG. 8*d* illustrates a panel setup with the panels being arranged in a staggered herringbone pattern. FIG. 8*e* illustrates a panel setup where the panels are arranged in a checkerboard pattern. FIG. 8*f* illustrates a panel setup where the panels are arranged in a so called flushed herringbone pattern.

The measurements resulted in the graphs in FIGS. 6*a* to 6*c* representing the STI versus the distance from the source as arranged in the three different measurement positions represented by lines A, B and C.

When assessing the 'acoustic quality' in an open plan office, objective parameters can be measured. The most important parameter is the 'radius of distraction' (RD), which equals the distance from a source at which the STI drops below a value of 0.5. Beyond this distance, workers will no longer be significantly disturbed by a talker when they are performing cognitive work. The RD value can be determined by evaluating the STI versus distance in an office. Typically, the STI values should be measured along a straight line. In the square office used here there is not really a 'favorable' direction of such a line. Therefore, three measurement lines are defined, shown in FIGS. 7*a* to 7*c*. FIG. 6*a* illustrates the results from the measuring line disclosed in FIG. 7*a*, i.e. along axis y representing a center line in the room. The measuring points are illustrated as A0, 1 to 9. FIG. 6*b* illustrates the results from the measuring line disclosed in FIG. 7*b* along axis x representing a line along one wall of the room. The measuring points are illustrated as A0, 10 to 21. FIG. 6*c* illustrates the results from a measuring line extenting diagonally along the room as illustrated in FIG. 7*c*. The measuring points are illustrated as A0, 22 to 37.

As can be seen from the graphs in FIGS. 6*a*-6*c*, in terms of 'STI versus distance' and 'radius of distraction', adding panels improves the overall acoustics of the office. Further, for measurement lines A and C, all panel configurations perform more or less equally. Also, for measurement line B, the staggered herringbone pattern shows the best results.

When mounted in a room, it is preferred that all panels are suspended with a well-defined inter-panel distance. It is preferred that the inter-panel distance e, see FIG. 1, between the second side 5 of the light-emitting panel 2 and the main surface 6 of the reflecting panel 3 is made essentially the same throughout all panels suspended from the ceiling. This applies also to the angle α between the main surfaces 6 of the light-emitting panel 2 and the reflective panel 3 respectively in each set of panels 100, 200, 300, which angle preferably, should be essentially the same throughout all panels suspended from the ceiling.

When suspended, it is preferred that the edges of the panels proximate the walls of the room are arranged on a distance thereto essentially corresponding to the inter-panel distance e. In this aspect, the walls of the room may be equalled with a main surface 6 of a reflective panel.

Further, it is preferred that all panels are arranged with their main surfaces at an angle relative to the walls of the room that provides an optimal acoustical attenuation. The angle relative to the wall is preferably an oblique angle such as 45 degrees.

Acoustical simulations have shown that compared to several reference arrangements, the arrangement according to the invention has a smaller radius of distraction, and therefore shows improved acoustical performance.

The person skilled in the art realizes that the present invention by no means is limited to the preferred embodiments described above. On the contrary, many modifications and variations are possible within the scope of the appended claims. For example, the panels may be provided with additional light sources on other positions than on the second side sides and on the first side facing away from the ceiling.

It is also to be understood that one and the same room may be provided with different sets of panels. By way of example, for a set of panels in which the light-emitting panel is to be arranged with one of its second sides facing the wall of the room, such "wall panel" may be provided with a light source only on the second side thereof intended to face the wall. It goes without saying that the wall as such may operate as a reflecting surface.

Likewise, for a set of panels where the panels are to be arranged in the room surrounded by other sets of panels, both opposing second side surfaces may be provided with a light source.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. A set of panels forming a lighting system, the set comprising a light-emitting acoustic panel and a light-reflecting acoustic panel, each panel having two opposing first sides, two opposing second sides and two opposing main surfaces, and each panel being suspended from a ceiling with a first side facing the ceiling, wherein the light-emitting acoustic panel includes a suspending member for suspending the acoustic panel from a ceiling, the suspending member being arranged on one of the first sides such that when the acoustic panel is suspended from the ceiling the two opposing main surfaces are arranged perpendicular to the ceiling, and a light source arranged on one of the second sides such that when the acoustic panel is suspended from the ceiling the light source is arranged to provide illumination in a main direction, the main direction being parallel to the ceiling and perpendicular to the normal of the main surfaces, and wherein at least one of the main surfaces of the light-reflecting panel is a light-reflecting surface, the light source of the light-emitting acoustic panel being arranged to illuminate the light-reflecting surface of the light-reflecting acoustic panel.

2. The set of panels according to claim 1, wherein the light-emitting acoustic panel and the light-reflecting acoustic panel are arranged in a staggered pattern in view of each other.

3. The set of panels according to claim 1, wherein the light-emitting acoustic panel comprises a light source arranged on both opposing second sides thereof.

4. The set of panels according to claim 1, wherein at least one of the light-emitting acoustic panel and the light-reflecting acoustic panel comprises a light source on one of their opposing first sides.

5. The set of panels according to claim 1, wherein the light-emitting acoustic panel in a first set of panels is arranged to constitute a light-reflecting panel in a second set of panels, the second set of panels comprising an light-emitting panel and a light-reflecting panel.

6. The set of panels according to claim 1, wherein the light-reflecting surface of the light-reflecting panel has light diffusing properties.

7. The set of panels according to claim 1, wherein the main surface of the light-emitting panel is arranged with an angle ($\alpha$) of 45 to 90 degrees in view of the main surface of the light-reflecting panel.

8. A lighting system comprising at least a first and a second set of panels according to claim 1, wherein the panels in the first set of panels and the second set of panels are arranged in a herringbone pattern, in which pattern the light-emitting panel of the first set of panels is arranged to constitute a light-reflecting panel when being illuminated by the light-emitting panel of the second set of panels.

9. A lighting system comprising at least a first and a second set of panels according to claim 1, wherein the panels in the first set of panels and the second set of panels are arranged in a checkerboard pattern, in which pattern the light-emitting panel of the first set of panels is arranged to illuminate the light-reflecting panel of the first set of panels and the light-reflecting panel of the second set of panels, and wherein the main surface of the light-emitting panel of the first set of panels is arranged essentially in parallel with the main surface of the light-emitting panel of the second set of panels, while the main surface of the light-reflecting panel of the first set of panels is arranged essentially in parallel with the main surface of the light-reflecting panel of the second set of panels.

* * * * *